US005923258A

United States Patent [19]

Tseng

[11] Patent Number: 5,923,258

[45] Date of Patent: Jul. 13, 1999

[54] ELECTRONIC THERMOMETER WITH HIGH INTENSITY FEVER ALARM

[75] Inventor: Daniel Chao Man Tseng, Taipei Hsien, Taiwan

[73] Assignee: K Jump Health Co., Ltd., Taiwan

[21] Appl. No.: 09/094,330

[22] Filed: Jun. 9, 1998

[51] Int. Cl.[6] ..... G08B 17/00

[52] U.S. Cl. ..... 340/584; 340/573.1; 340/384.1

[58] Field of Search ..... 340/573.1, 573.3, 340/584, 586, 588, 589, 384.1, 384.2, 384.4, 384.6, 384.73; 381/26, 28, 61, 62

[56] References Cited

U.S. PATENT DOCUMENTS

| | | | |
|---|---|---|---|
| 3,916,104 | 10/1975 | Anazawa et al. | 381/26 |
| 3,931,620 | 1/1976 | Wellman, Jr. et al. | 340/599 |
| 4,159,648 | 7/1979 | Prosky | 374/170 |
| 4,162,372 | 7/1979 | Gross | 381/62 |
| 4,444,517 | 4/1984 | Murase | 374/188 |
| 4,572,213 | 2/1986 | Kawahara | 600/549 |
| 4,743,121 | 5/1988 | Takagi et al. | 374/163 |
| 4,763,112 | 8/1988 | Hsieh | 340/573.1 |
| 4,819,860 | 4/1989 | Hargrove et al | 340/573.1 |
| 4,904,997 | 2/1990 | Chen et al. | 340/870.17 |
| 5,013,161 | 5/1991 | Zaragoza et al. | 374/208 |
| 5,165,798 | 11/1992 | Watanabe | 374/208 |
| 5,483,503 | 1/1996 | Kimball | 368/67 |
| 5,528,559 | 6/1996 | Lucas | 368/10 |
| 5,559,497 | 9/1996 | Hong | 340/573.1 |
| 5,575,563 | 11/1996 | Chiu et al. | 374/141 |

*Primary Examiner*—Daniel J. Wu
*Assistant Examiner*—Van T. Trieu
*Attorney, Agent, or Firm*—Olson & Hierl, Ltd.

[57] ABSTRACT

An electronic thermometer features a high intensity, dual media fever alarm. The thermometer includes a temperature detection module for generating a digital temperature signal and a fever signal. Elements responsive to the temperature and fever signal are provided to display a temperature readout and provide a fever alarm that is both audible by use of a buzzer and visible at the thermometer display. For providing these functions, the thermometer also includes a sound oscillator for generating a buzzer alarm signal, a flash oscillator for generating a display flash signal, an alarm controller responsive to the fever signal for alarm activation, a display module for displaying the a fever indication, a buzzer signal optimizer for enhancing buzzer intensity and an associated buzzer for generating the audible portion of the fever alarm.

8 Claims, 4 Drawing Sheets

ELECTRONIC THERMOMETER WITH HIGH INTENSITY FEVER ALARM

TECHNICAL FIELD OF THE INVENTION

The present invention relates to an electronic thermometer for detecting and digitally displaying body temperature. More particularly, the present invention pertains to a clinical thermometer with multimedia alarming.

BACKGROUND OF THE INVENTION

Hand held electronic thermometers offer many advantages over glass-tube mercury thermometers. In the basic electronic thermometer design, a temperature sensing element is connected to a combined, battery-powered computing and display element. These components are housed in a rigid plastic case having a probe with handle shape. The temperature sensing element is mounted at the end of the probe section and covered with a metal cap. The computing and display element as well as the battery are secured in the handle section of the rigid case, where a viewing window is provided for the temperature display and an access door is optionally provided for battery replacement. The components are interconnected by wires or leads.

Although such thermometers have enjoyed widespread commercial acceptance since the 1970s, efforts at improvement on this basic design continued. To date, many advancements have been made. Exemplary advancements include mouth-friendly flexible probes, fast-response sensing elements, and audible signaling.

Concerning audible signaling, U.S. Pat. No. 5,165,798 to Watanabe describes an electronic thermometer with an electronic buzzer that is used to indicate the completion of a temperature measurement.

The conventional thermometer buzzer is low volume, and therefore difficult for some users to detect, particularly those with hearing loss. While volumes can be increased by applying greater power and using larger buzzers, such standard techniques would add impermissibly to unit size and cost.

Furthermore, conventional thermometers lack a cost-effective, easily identifiable indication that the measured temperature is in the fever range.

The present invention overcomes this cost-to-dectectability compromise by providing a low-cost electronic thermometer having a dual media fever alarm and a relatively high volume buzzer.

SUMMARY OF THE INVENTION

An electronic thermometer with multimedia fever alarm is provided for measuring body temperature. This device includes a temperature detection module, a sound oscillator, a flash oscillator, an alarm controller, a display module, a buzzer signal optimizer, and a buzzer.

The temperature detection module generates a digital temperature signal and a fever signal, while the sound oscillator produces an alarm sound signal and the flash oscillator produces a display flash signal. The alarm controller is operably connected to the alarm sound signal, the display flash signal, and the fever signals. The alarm controller produce a buzzer output signal and a display output signal according to the status of the fever signal. A display module is responsive to both the display output signal for showing a visual fever indication and the digital temperature signal for showing a temperature readout. The buzzer is driven by an operably connected buzzer signal optimizer to produce a relatively loud sound alarm. The buzzer signal optimizer, and therefore the buzzer, respond to the buzzer output signal from the alarm controller.

The digital thermometer is designed to produce an unmistakable fever alarm indication. The visual fever indication of the display module is optionally a flashing temperature readout. Furthermore, the buzzer may be driven at a frequency that is unique to the fever condition.

There are other advantages and features of the present invention which will be more readily apparent from the following detailed description of the preferred embodiment of the invention, the drawings, and the appended claims.

DESCRIPTION OF THE PREFERRED EMBODIMENT

Figure 1:
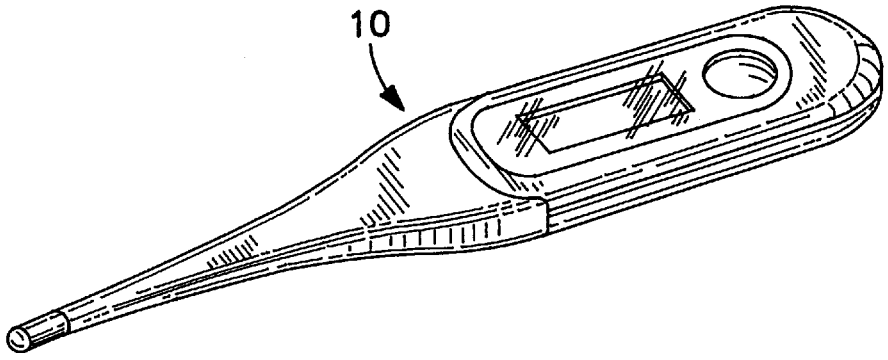
FIG. 1 is a perspective view of the outward appearance of an electronic thermometer according to the present invention.

While this invention is satisfied by embodiments in many different forms, there is shown in the drawings and will be described herein in detail specific embodiments of the invention with the understanding that this disclosure is to be considered a demonstration of the principles of the claimed invention and is not to be limited to the specific embodiments illustrated.

Figure 2:
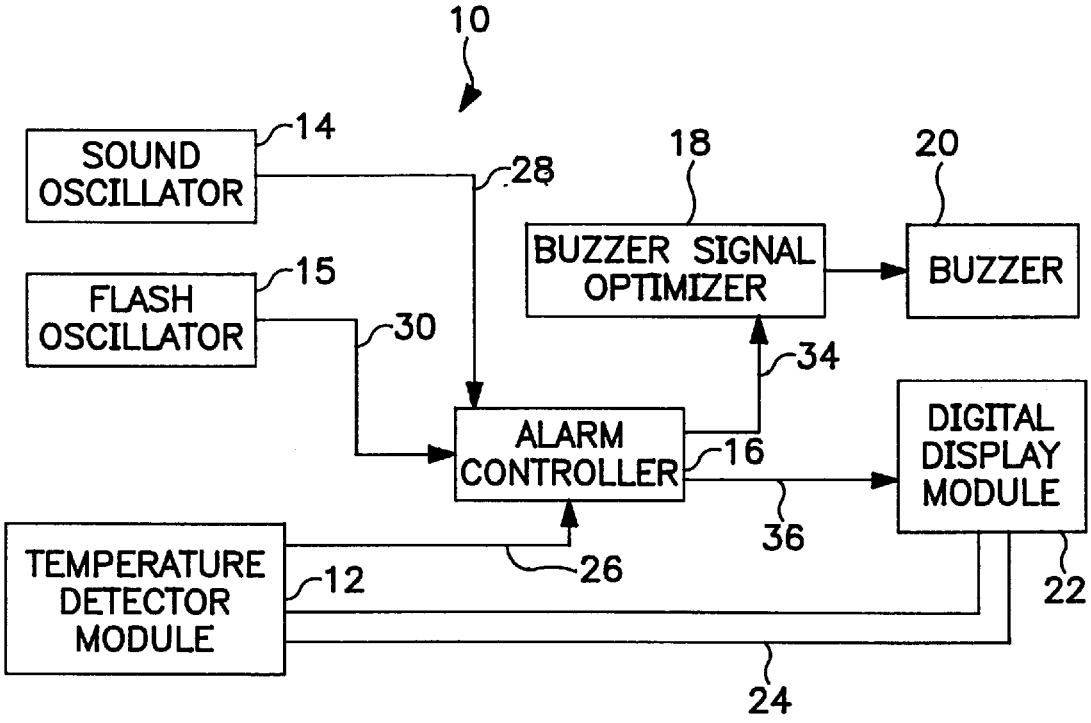
FIG. 2 is a simplified block diagram of an electronic thermometer according to the present invention.

The present invention provides an electronic thermometer having a dual-media fever alarm and high-intensity buzzer. Referring to the drawings, FIG. 1 gives the outward appearance of a digital thermometer according to the present invention. In FIG. 2, an electronic thermometer in accordance with the present invention is depicted in block diagram format. Within FIG. 2 and the other block diagrams (FIGS. 3–4), a single block may indicate several individual components and/or circuits which collectively perform a single function. Likewise, a single line may represent several individual signal or energy transmission paths for performing a particular operation.

As shown, the electronic thermometer 10 includes a temperature detector module 12, a sound oscillator 14, a flash oscillator 15, an alarm controller 16, a buzzer signal optimizer 18, a buzzer 20, and a digital display module 22. Temperature detection module 12 provides a digital temperature signal 24 that is received by digital display module 22 and a fever signal 26 that is received by alarm controller 16. Sound oscillator 14 generates an alarm sound signal 28, while display oscillator 15 generates a display flash signal 30. Alarm sound signal 28 is a relatively slow pulse train operating at the desired audible frequency for the buzzer when sounding an alarm. A frequency of 16 Hertz is preferred in order to draw greater attention to the alarm, though others within the audible range may of course be selected. It is also preferable that the frequency of alarm sound signal 28 be noticeably different than other buzzer signals. With a unique frequency, the buzzer sound for a fever alarm can be readily distinguished from other customary buzzer signals such as the end-of-measurement signal.

Also a pulse train, display flash signal 30 operates at the desired frequency for a visual fever indication at thermometer display 32 (FIG. 1). With 1 Hertz being preferred for reduced component cost, the frequency of display flash signal 30 may be selected for increased visual effect. Both of these oscillating signals are inputs to alarm controller 16.

For these inputs, alarm controller 16 has two corresponding signal outputs. A buzzer output signal 34 corresponds to alarm sound signal 28, and a display output signal 36 corresponds to display flash signal 30. In function, alarm controller 16 is responsive to fever signal 26. Fever signal 26 is a binary signal, being set to "on" by temperature detector module 12 when the detected temperature is within fever range. When the status of fever signal 26 is "on," alarm controller 28 allows sound signal 28 to pass through to buzzer output signal 34 and display flash signal 30 to pass through to display output signal 36. When the status is "off," these connections are broken.

Figure 3:
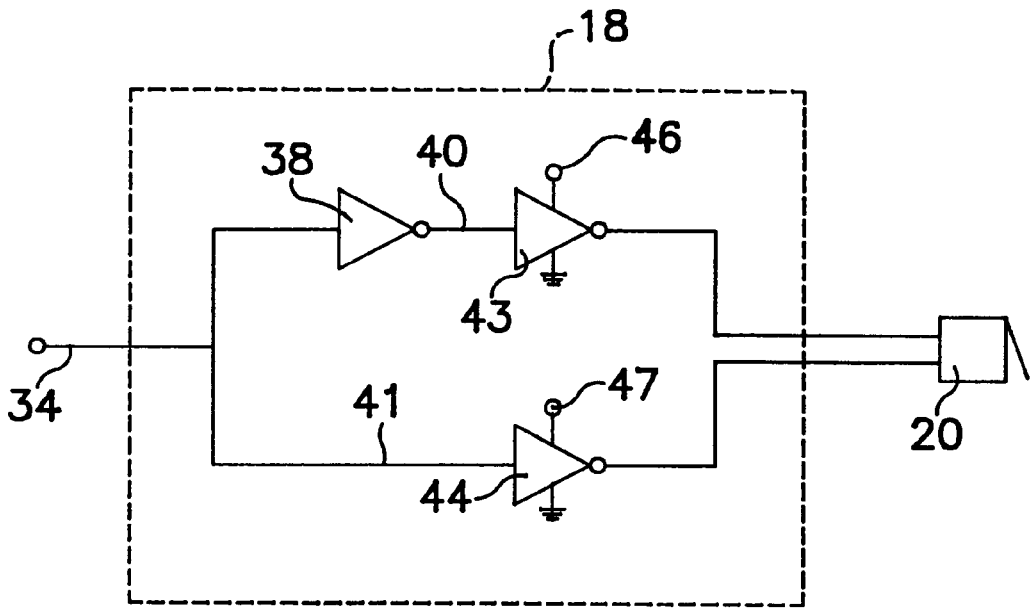
FIG. 3 is a block diagram of a buzzer signal optimizer and a buzzer according to the present invention.
Figure 4:
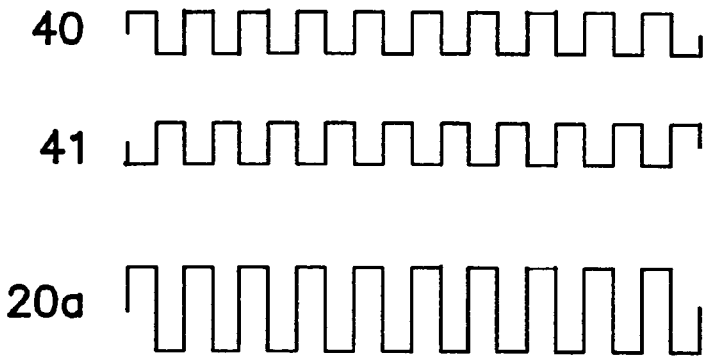
FIG. 4 is graph of waveforms corresponding to the buzzer input signals depicted in FIG. 4.

Buzzer output signal 34 is received by buzzer signal optimizer 18, which is operably connected to buzzer 20 as shown. FIG. 3 shows an embodiment of buzzer signal optimizer 18 together with buzzer 20. As illustrated, a phase inverter (or phase shifter) 38 operates in a parallel circuit to generate complementary signals 40 and 41, which therefore differ in phase by 180 degrees. Optional boosting inverters 43 and 44 are directly powered by the power source (not shown) through terminals 46 and 47, respectively. Phase inverter 38 and boosting inverters 43 and 44 are preferably CMOS inverters. FIG. 4 contains symbolic waveforms for complimentary signals 40 and 41 as well as waveform 20*a*, a composite of these signals 40 and 41 representing the effective signal reaching buzzer 20.

Accordingly, buzzer signal optimizer 18 provides a driving signal to buzzer 20 having an amplitude twice that of the power source voltage. The higher effective amplitude gives buzzer 20 a relatively louder buzzer than conventional thermometers without requiring a stronger power source.

Referring again to FIG. 2, display output signal 36 is received by digital display module 22, as is digital temperature signal 24. The digital temperature signal 24 is a digital representation of the temperature measurement of electronic thermometer 10. This signal is provided to digital display module 22 for display as a temperature read-out in the conventional manner, except that the temperature read-out is flashed on and off according to the frequency of display output signal 36.

Numerous display modules suitable for electronic thermometers are commercially available. Commercially practical display modules generally include a decoder (or controller), a driver, and a display element such as a multi-segment liquid crystal display (LCD). Accordingly, various conventional techniques are available for flashing the temperature read-out at the frequency of an input pulse train such as display output signal 36. For example, the oscillation of display output signal 36 can be applied to the display element power signal as a switch by using a conventional AND gate. Using this approach, the display element is cycled on and off at the frequency of display output signal 36.

Figure 5:
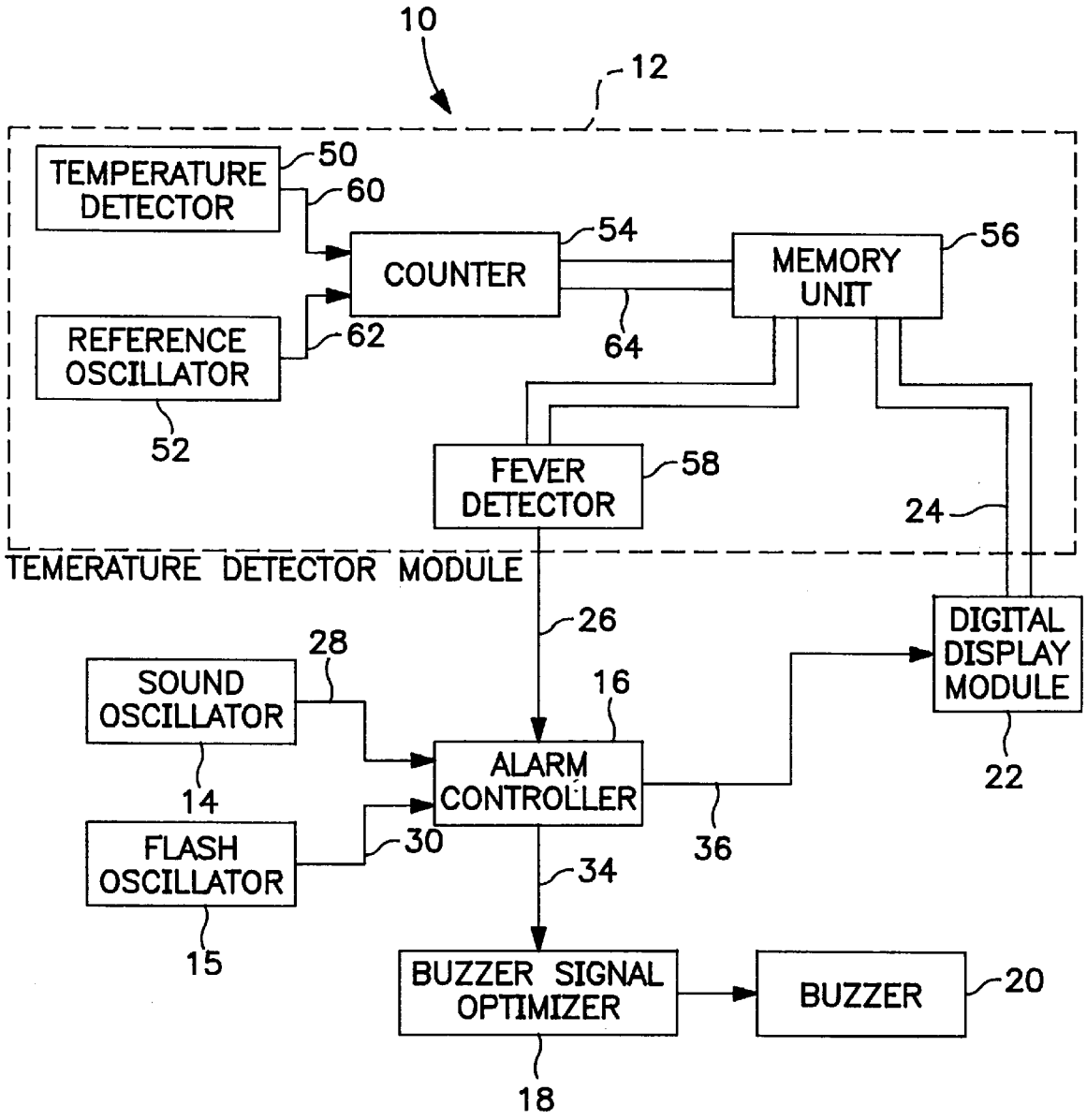
FIG. 5 is another simplified block diagram of an electronic thermometer according to the present invention.

As noted above, fever detector module 12 serves at least two functions. First, it generates a digital temperature signal for display. Second, it generates a fever signal which indicates whether the measured temperature is within the fever range. Fever detector module 12 may be of various conventional designs and include a variety of circuit elements. FIG. 5 is a block diagram of an electronic thermometer in accordance with the present invention in which greater detail is provided for the design of a temperature detector module.

Temperature detector module 12 may include a temperature detector 50, a reference oscillator 52, a counter 54, a memory unit 56, and a fever detector 58. Temperature detector 50 serves as a temperature sensitive oscillator for generating an oscillating temperature signal 60. Accordingly, the frequency of temperature signal 60 varies according to the temperature of the thermometer sensor (not shown). Reference oscillator 52 generates a reference signal 62 that has a relatively lower frequency than the temperature signal.

Both temperature signal 60 and reference signal 62 are received by counter 54. Responding to these oscillating signals, counter 54 interprets or counts the pulses of temperature signal 60 on the basis of reference signal 62. The resulting pulse count is proportional to the sensed temperature. The simple conversion between pulse count and temperature value can occur at various points within thermometer 10. For ease of description, however, the output of counter 54 can be labelled a temperature reading with the understanding that the conversion may actually occur elsewhere.

Counter 54 is operably connected to memory unit 56. Suitably labelled a temperature reading 64, the output of counter 54 passes to memory unit 56, where a maximum temperature reading is detected and stored. Specifically, memory unit 56 includes a comparator for determining whether temperature reading 64 is greater than the previously stored maximum. If greater, the temperature reading 64 is then stored for display, fever detection and further comparisons.

Memory unit 56 is in turn operably connected to fever detector 58 and digital display module 22. As noted above, fever detector 59 processes the maximum temperature stored in memory unit 56 to detect a fever condition. Specifically, the maximum detected temperature is compared to a normal limit value stored in said fever detector. The normal limit is preferably 37.5° C. (99.5° F.), but may of course vary according to the target patient group. If the maximum detected temperature is greater than the normal limit, fever detector 58 sets the status of its output signal, fever signal 26, to "on." Fever signal 26 serves as an indicator to alarm controller 16 as previously described.

Figure 6:
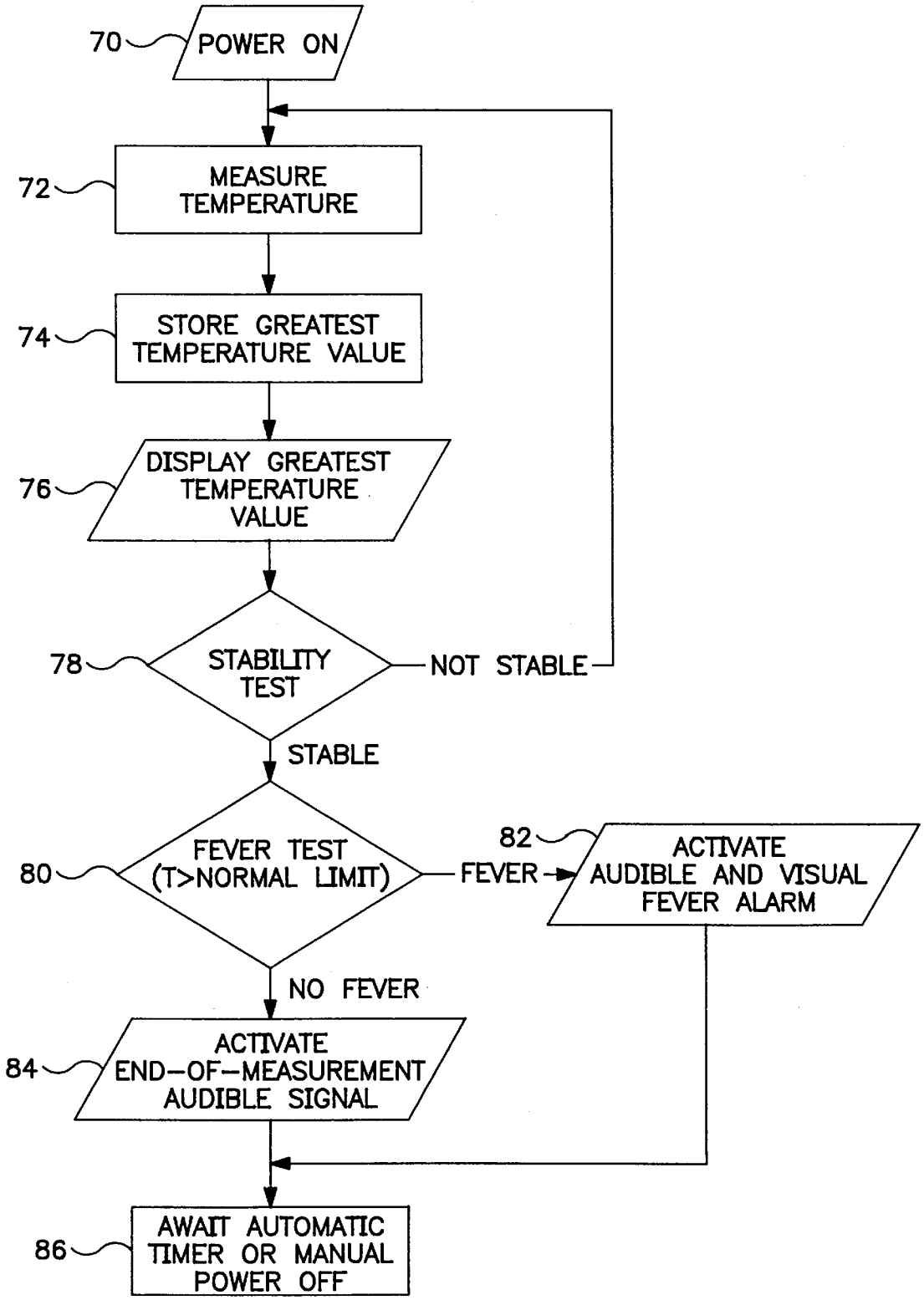
FIG. 6 is a flow chart illustrating the operation of an electronic thermometer according to the present invention.

FIG. 6 illustrates the operation of a thermometer according to the present invention. When power is turned on (box 70), measurement begins with temperature detector 50 generating a temperature dependent signal that is counted by counter 54 as indicated by box 72. Next, memory unit 56 compares temperature reading 64 with a stored maximum temperature reading and stores the greater value (box 74). To ensure that first measured temperature is stored, the maximum temperature reading of memory unit 56 is initialized to zero or some equivalent.

The stored maximum temperature is delivered to digital display module 22 in the form of digital temperature signal 24 for display (box 76).

As is customary with electronic thermometers, the temperature measurement is evaluated for stability by comparison with the last or previous reading (box 78). If a temperature change is detected, the measurement process is repeated until the measured temperature stabilizes.

With the stability test completed, the temperature measurement is evaluated by fever detector 58 to determine if it falls within fever range (box 80). Specifically, the maximum temperature value is compared with a normal limit. If a fever is detected, audible and visual fever alarms are activated by alarm controller 16 (box 82). If a fever is not detected, an end-of-measurement audible signal is generated in the conventional manner (box 84). Following either fever alarming (box 82) or end-of-measurement signalling (box 84), the electronic thermometer continues to display the temperature measurement while awaiting either automatic or manual power-off (box 86).

A detailed discussion of the conventional electronic elements for performing the customary stability test (box 82), end-of-measurement signal (box 84), and automatic power off (box 86) has been avoided to aid in understanding the present invention. These functions and their associated elements are known and do not form a part of this invention.

A key feature of the present invention is its distinctive and readily apparent dual media fever alarm. The built-in fever detection aids users who may be unable to remember the normal limit for body temperature. Furthermore, the fever alarm has been made visual as well as audible to ensure that even hearing or visually impaired users can recognize the fever condition. The buzzer sound level for the audible portion of the fever alarm has been increased in a cost-effective manner by optimizing the buzzer driving signal.

Numerous variations and modifications of the embodiments described above may be effected without departing from the spirit and scope of the novel features of the invention. It is to be understood that no limitations with respect to the specific system illustrated herein are intended or should be inferred. It is, of course, intended to cover by the appended claims all such modifications as fall within the scope of the claims.

I claim:

1. An electronic thermometer comprising:

a temperature detector module for generating a digital temperature signal and a fever signal;

a sound oscillator for generating an alarm sound signal;

a flash oscillator for generating a display flash signal;

an alarm controller operably connected to said alarm sound signal, said display flash signal, and said fever signal, said alarm controller having a buzzer output signal and a display output signal;

a digital display module responsive to said display output signal and said temperature signal for producing a visual fever indication corresponding to said display output signal and a temperature read-out corresponding to said temperature output;

a buzzer signal optimizer responsive to said buzzer output signal; and a buzzer for generating a sound alarm, said buzzer being operably connected to said buzzer signal optimizer.

2. The electronic thermometer according to claim 1 wherein said buzzer signal optimizer includes a phase shifter responsive to said buzzer output signal for producing a complimentary signal.

3. The electronic thermometer according to claim 2 wherein said buzzer signal optimizer further includes a parallel circuit for adding said complimentary signal to said buzzer output signal.

4. The thermometer according to claim 2 wherein said phase shifter is an inverter.

5. The thermometer according to claim 4 wherein said inverter is a CMOS inverter.

6. The thermometer according to claim 1 wherein said buzzer is a piezoelectric buzzer.

7. An electronic thermometer comprising:

a temperature detector module for generating a buzzer control signal;

a sound oscillator for generating an alarm sound signal;

a buzzer signal controller responsive to said control signal and operably connected to said alarm sound signal, said buzzer signal controller having a controlled signal output;

a buzzer signal optimizer including a phase shifter responsive to said controlled signal for generating complimentary signals;

a buzzer operably connected to said complimentary signals for generating sound.

8. An electronic thermometer comprising:

a temperature detector for generating a temperature signal;

a reference oscillator for generating a reference signal, said reference signal having a relatively lower frequency than said temperature signal;

a counter responsive to said temperature signal and said reference signal for counting the temperature signal on the basis of said reference signal and generating a temperature reading;

a temperature memory unit operably connected to said counter for detecting and storing a maximum temperature reading;

a fever detector operably connected to said memory unit for generating a fever signal when said maximum temperature is greater than a normal limit, said normal limit being stored in said fever detector;

a sound oscillator for generating an alarm sound signal;

a flash oscillator for generating a display flash signal;

an alarm controller responsive to said fever signal, and operably connected to said alarm sound signal and said display flash signal; said alarm controller having a buzzer output signal and a display output signal;

a digital display module operably connected to said memory unit and responsive to said display output signal for producing a visual fever indication corresponding to said display output signal and a temperature read-out corresponding to the temperature value stored in said memory unit;

a buzzer signal optimizer responsive to said buzzer output signal;

a buzzer for generating a sound alarm, said buzzer being operably connected to said buzzer signal optimizer.

* * * * *